US007906921B2

(12) United States Patent
Wang et al.

(10) Patent No.: US 7,906,921 B2
(45) Date of Patent: Mar. 15, 2011

(54) INDUCTION ACTUATED CONTAINER

(76) Inventors: Xin Wang, City of Industry, CA (US); Jiang Qun Chen, City of Industry, CA (US)

( * ) Notice: Subject to any disclaimer, the term of this patent is extended or adjusted under 35 U.S.C. 154(b) by 466 days.

(21) Appl. No.: 12/154,519

(22) Filed: May 23, 2008

(65) Prior Publication Data

US 2008/0296298 A1 Dec. 4, 2008

(51) Int. Cl.
*B65D 55/00* (2006.01)

(52) U.S. Cl. ..... 318/266; 318/283; 220/211; 220/260

(58) Field of Classification Search ..... 220/200, 220/211, 255, 260; 318/256, 264–266, 280, 318/283, 286, 466–468, 487
See application file for complete search history.

(56) References Cited

U.S. PATENT DOCUMENTS

| | | | | |
|---|---|---|---|---|
| 5,667,136 | A * | 9/1997 | Chen | 232/43.2 |
| 6,150,939 | A * | 11/2000 | Lin | 340/568.1 |
| 6,626,317 | B2 * | 9/2003 | Pfiefer et al. | 220/263 |
| 6,859,005 | B2 * | 2/2005 | Boliver | 318/480 |
| 7,741,801 | B2 * | 6/2010 | Fukuizumi | 318/480 |
| 2002/0190615 | A1 * | 12/2002 | Lin | 312/297 |
| 2004/0174268 | A1 * | 9/2004 | Scott et al. | 340/686.6 |

* cited by examiner

*Primary Examiner* — Bentsu Ro
(74) *Attorney, Agent, or Firm* — Raymond Y. Chan; David and Raymond Patent Firm

(57) ABSTRACT

A container includes a container body and a container cover. The container cover includes a cover seat, a door panel and an induction actuation arrangement. The cover seat has an accessing window communicating with a container cavity. The door panel is pivotally coupling with the cover seat to move between a closed position and an opened position. The induction actuation arrangement includes an induction unit supported by the cover seat for detecting a presence of an object approaching the cover seat within a detection area of the induction unit, and an actuation unit driving the door panel between the closed position and the opened position.

20 Claims, 19 Drawing Sheets

INDUCTION ACTUATED CONTAINER

BACKGROUND OF THE PRESENT INVENTION

1. Field of Invention

The present invention relates to a container, and more particularly to an induction actuated container comprising a door panel which can be swung open through a sideward movement thereof for minimizing an accessible-height restriction of the container.

2. Description of Related Arts

A conventional container, such as an automatic trash can, usually comprises a container body having a storage cavity, a cover seat having a trash opening provided on top of the container body, and an automated actuation system typically comprising an actuation unit and a cover panel operatively communicated with the actuation unit for being moved between an opened position and a closed position, wherein in the opened position, the cover panel is pivotally and upwardly moved to expose the trash opening to an exterior of the container so as to allow a user to dispose trash into the storage cavity, wherein in the closed position, the cover panel is pivotally and downwardly moved to completely cover the trash opening so as to block access between the storage cavity and an exterior thereof. The actuation unit usually comprises a power device, such as a motor operatively connected to the cover panel, and a sensor positioned on the cover seat in such a manner that when the sensor detects an object or a physical movement above the cover seat, the sensor will send a signal to actuate the power device for moving the cover panel from the closed position to the opened position.

This kind of conventional container suffers from a number of disadvantages. First, in order to move from the closed position to the opened position, the cover panel is usually designed to be moved pivotally and upwardly from the cover seat. This requires substantial space right above the cover seat for it to be pivotally and upwardly driven for allowing exposure of the trash opening. In other words, the conventional container cannot be stored in a compartment having a height less than that of the container when the cover panel is at the opened position. This requirement substantially reduces the number of suitable places available for storing such a conventional container.

Second, since the cover panel is required to move from the closed position to the opened position by the pivotal upward movement, the user must allow the cover panel to have moved upwardly before he or she can dispose the trash into the storage cavity. This impart substantial inconvenience to the user in that he or she has to hold the trash (at a distance from the cover seat) and wait the cover panel to complete the upward pivotal movement every time he or she wishes to dispose the trash into the storage cavity.

Third, the majority of automatic trash cans described above are pre-programmed to allow opening of the trash opening for a predetermined period of time. In other words, the storage cavity will only be opened for receiving trash for a predetermined and limited period of time and the cover panel will be driven to move back to the closed position when that predetermined period of time lapses. Thus, there is no way for the user to adjust that predetermined period of time in order to allow the cover panel to stay at the opened position for an extended or an optimal period of time. This also impart substantial inconvenience to the user, especially when he or she is doing something (such as cleaning his or her house) which requires that the trash opening to be opened for an extended period of time. Whenever the cover panel has moved back to the closed position, the user has to restart the sensing process and wait for the cover panel to be driven to move to the opened position again.

SUMMARY OF THE PRESENT INVENTION

A main object of the present invention is to provide an induction actuated container comprising a door panel which can be promptly and conveniently swung open through a sideward movement thereof for minimizing an accessible-height restriction of the container.

Another object of the present invention is to provide an induction actuated container comprising an induction actuation arrangement for controlling a swinging movement of the door panel, wherein the door panel will remain open when the induction actuation arrangement is continuously detecting the presence of a user within a detection area. In other words, it is possible for the user to get an extended period of opening period of the door panel.

Another object of the present invention is to provide an induction actuated container which can be embodied as a wide variety of container types so that the present invention manufactured for different purposes and can be used in a wide variety of circumstances.

Another object of the present invention is to provide an induction actuated container which does not involve complicated and expensive mechanical or electrical components so as to minimize the manufacturing cost of the present invention.

Another object of the present invention is to provide an induction actuated container which is easy and convenient to use so as to facilitate a widespread application of the present invention.

Another object of the present invention is to provide an induction actuated container which comprises a door panel arranged to swing sidewardly for opening and closing a container cavity so as to minimize the electrical energy necessary for operating the door panel. Specifically, the present invention does not require that portion of electrical energy which is used to overcome a gravitational force of an otherwise upwardly moving door panel as equipped in a conventional container.

Accordingly, in order to accomplish the above objects, the present invention provides a container, comprising:

a container body having a container cavity and a top opening communicating with the container cavity; and a container cover which comprises:

a cover seat being sat at the top opening of the container body, wherein the cover seat has an accessing window communicating with the container cavity;

a door panel pivotally coupling with the cover seat to move between a closed position and an opened position, wherein at the closed position, the door panel is retained to cover the accessing window to enclose the container cavity of the container body, and at the opened position, the door panel is pivotally and sidewardly swung to expose the accessing window for communicating with the container cavity so as to minimize an accessible-height restriction of the container cover for the door panel to be actuated; and an induction actuation arrangement which comprises an induction unit supported by the cover seat for detecting a presence of an object approaching the cover seat within a detection area of the induction unit, and an actuation unit driving the door panel between the closed position and the opened position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
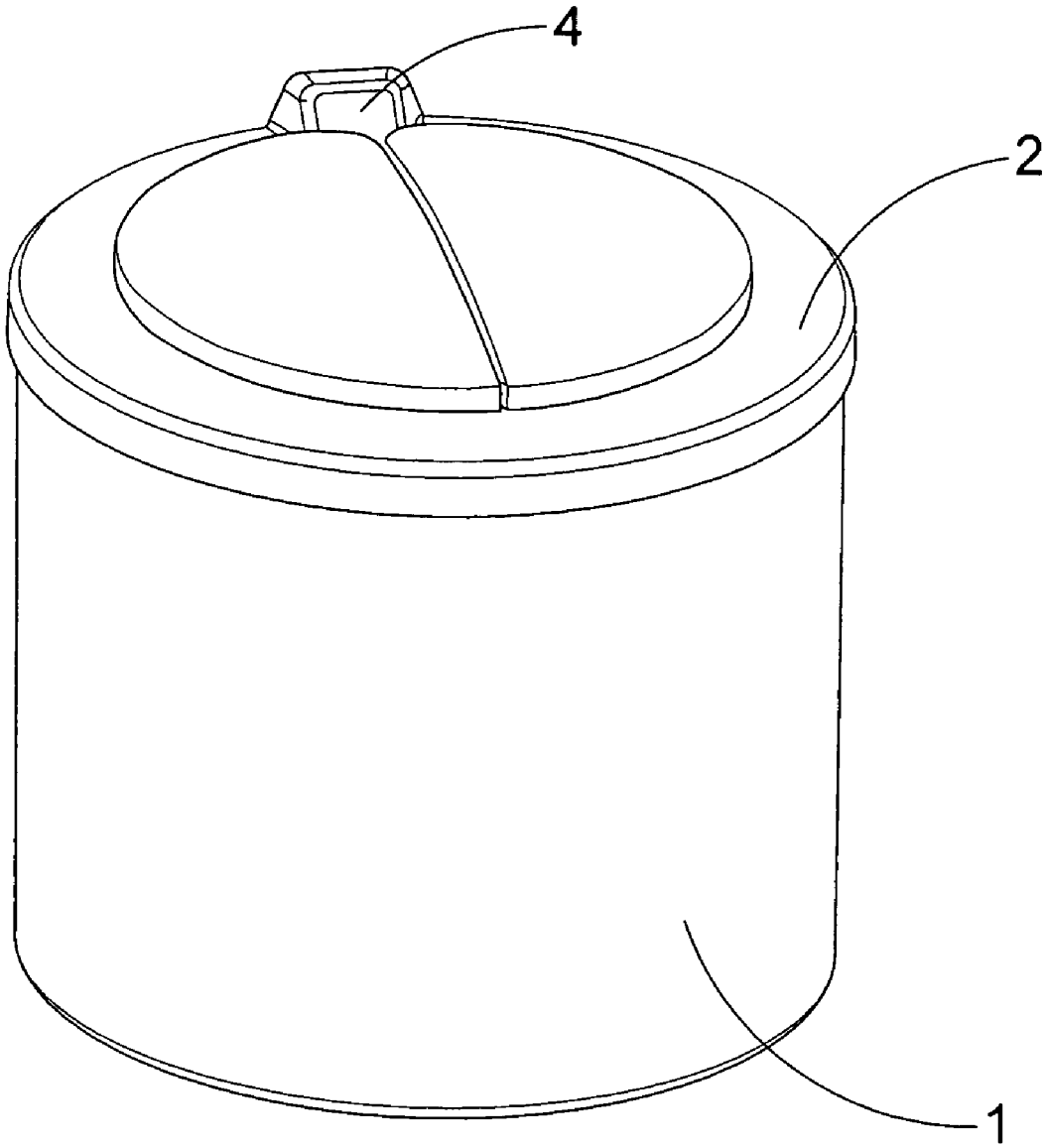
FIG. 1 is a first perspective view of a container according to a preferred embodiment of the present invention.
Figure 2:
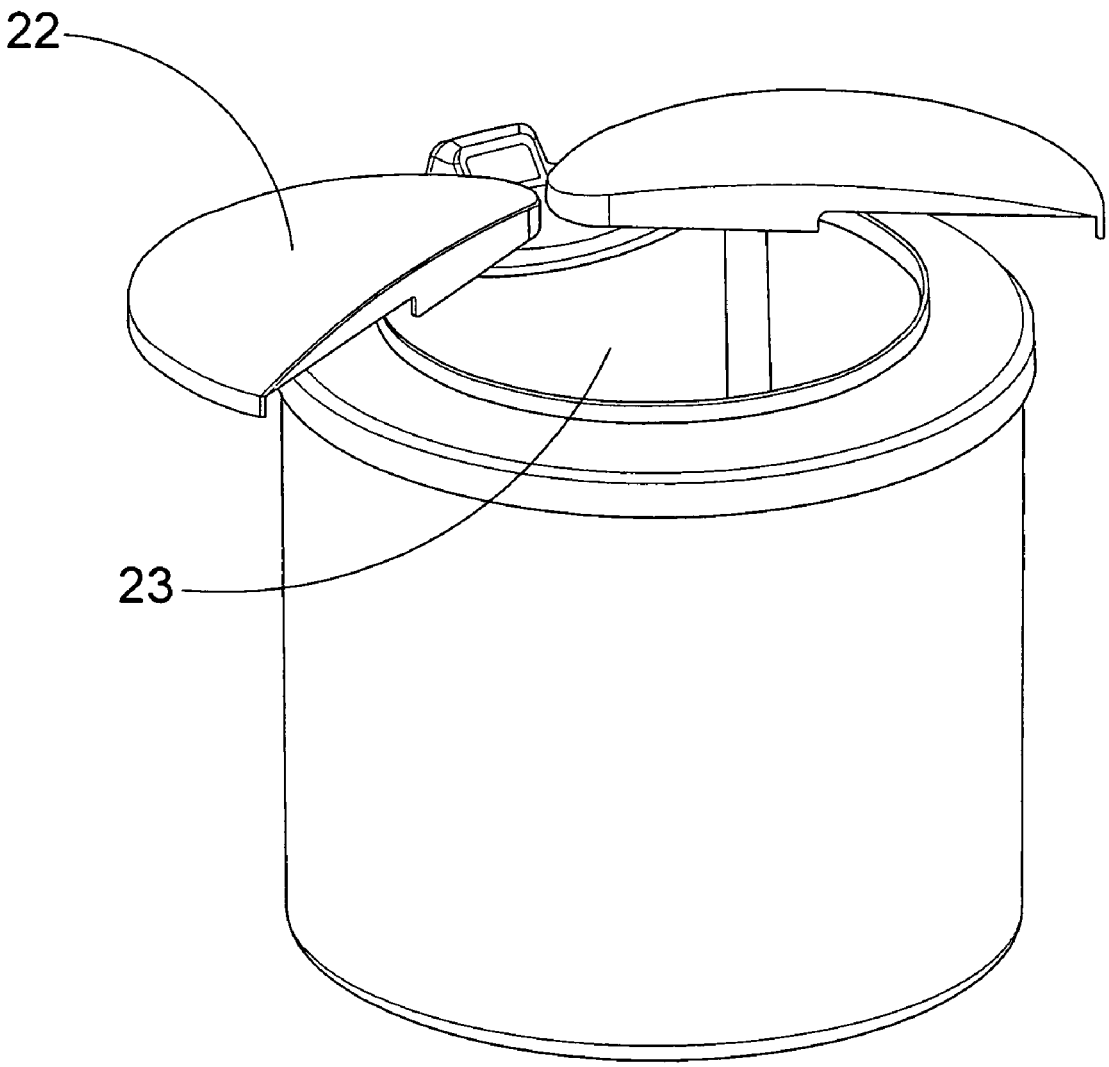
FIG. 2 is first schematic view of the container according to the above preferred embodiment of the present invention.
Figure 3:
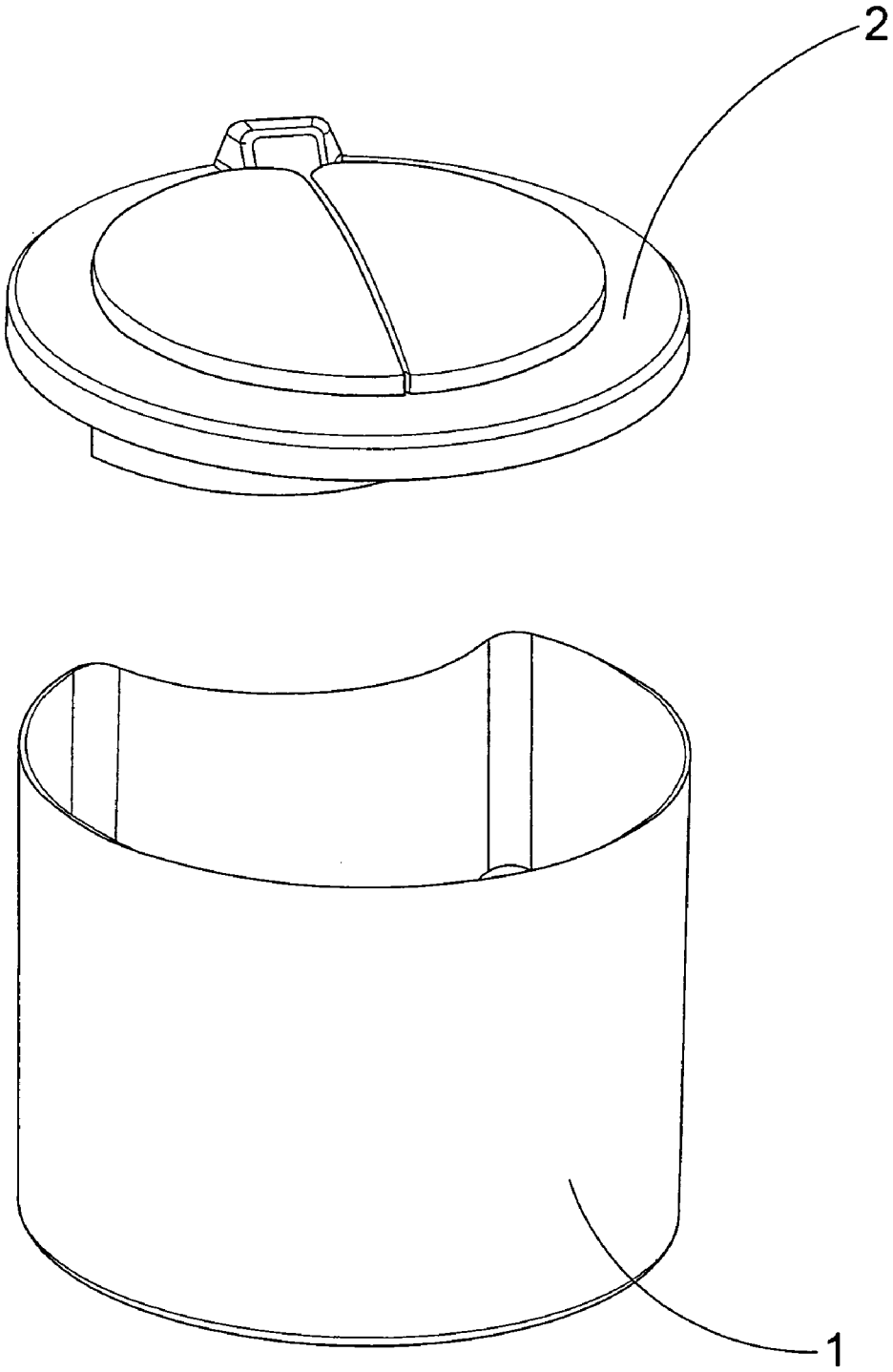
FIG. 3 is second schematic view of the container according to the above preferred embodiment of the present invention.
Figure 4:
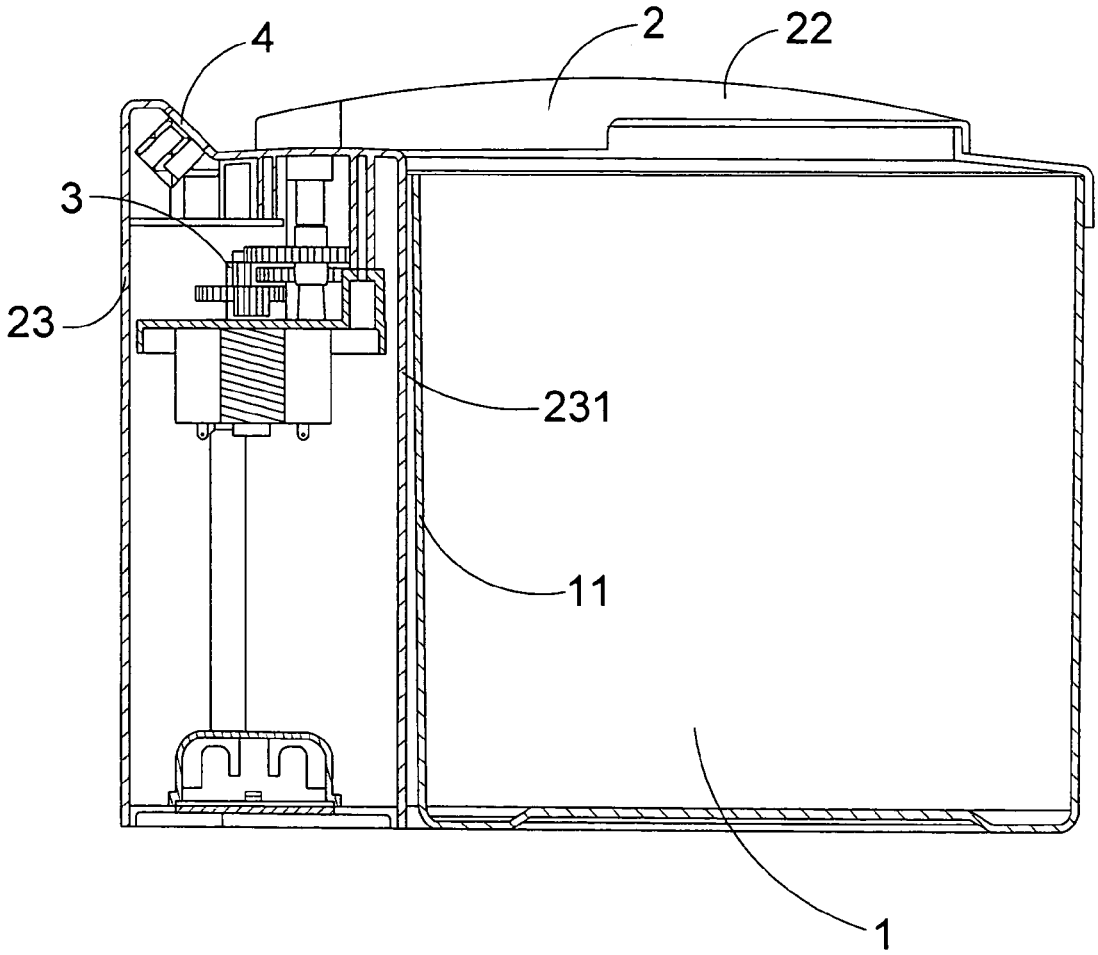
FIG. 4 is a first sectional side view of the container according to the above preferred embodiment of the present invention.
Figure 5:
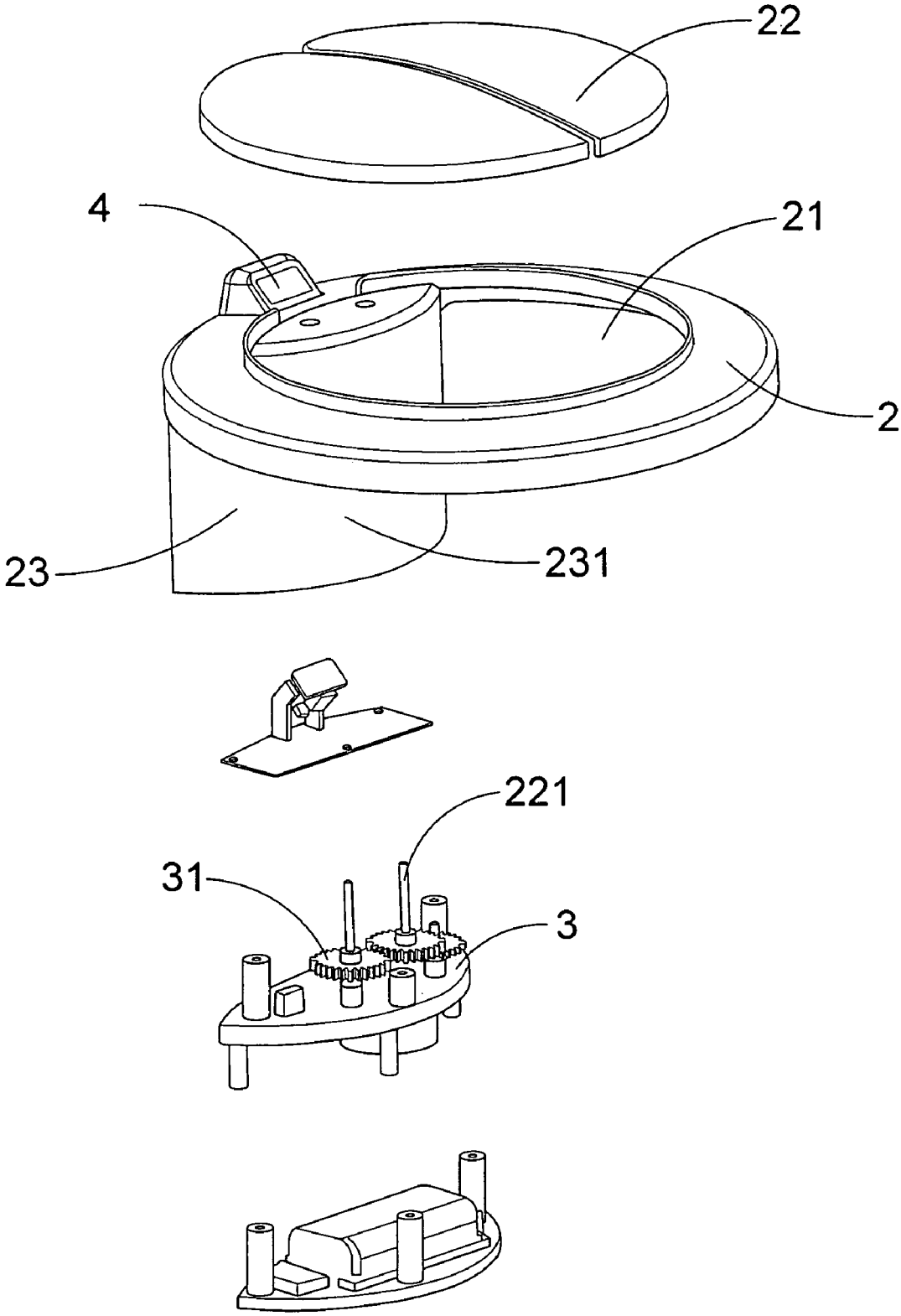
FIG. 5 is a first exploded perspective view of the container according to the above preferred embodiment of the present invention.
Figure 6A:
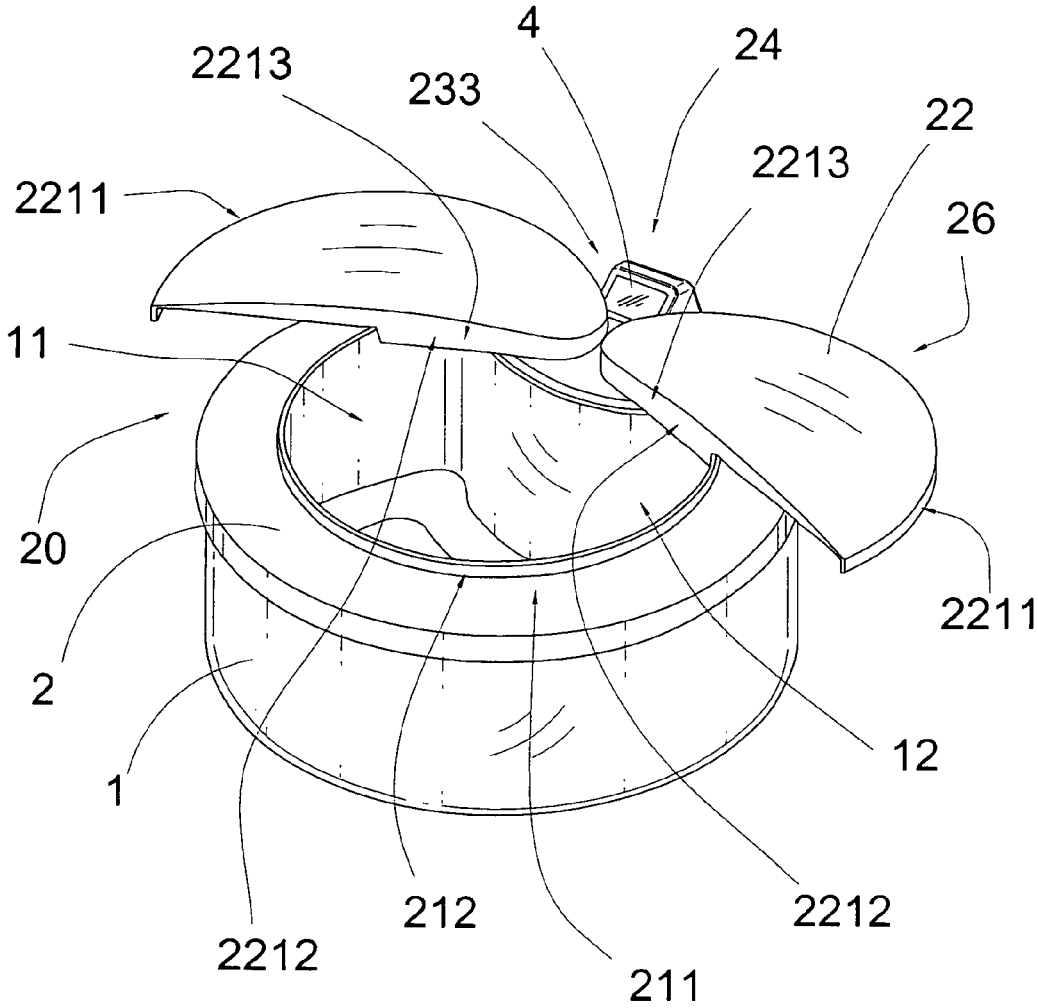
FIG. 6A and FIG. 6B are second schematic views of the container according to the above preferred embodiment of the present invention.
Figure 6B:
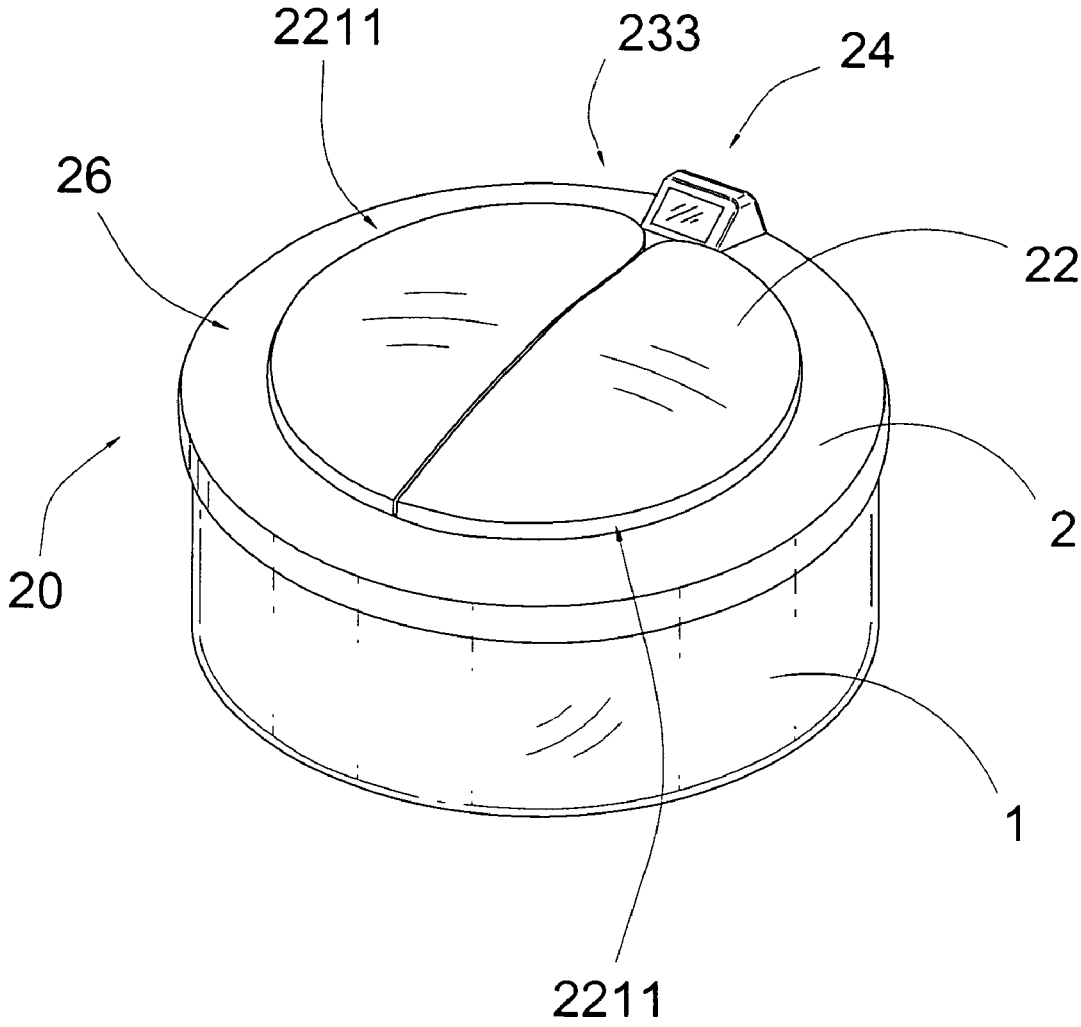
Figure 7:
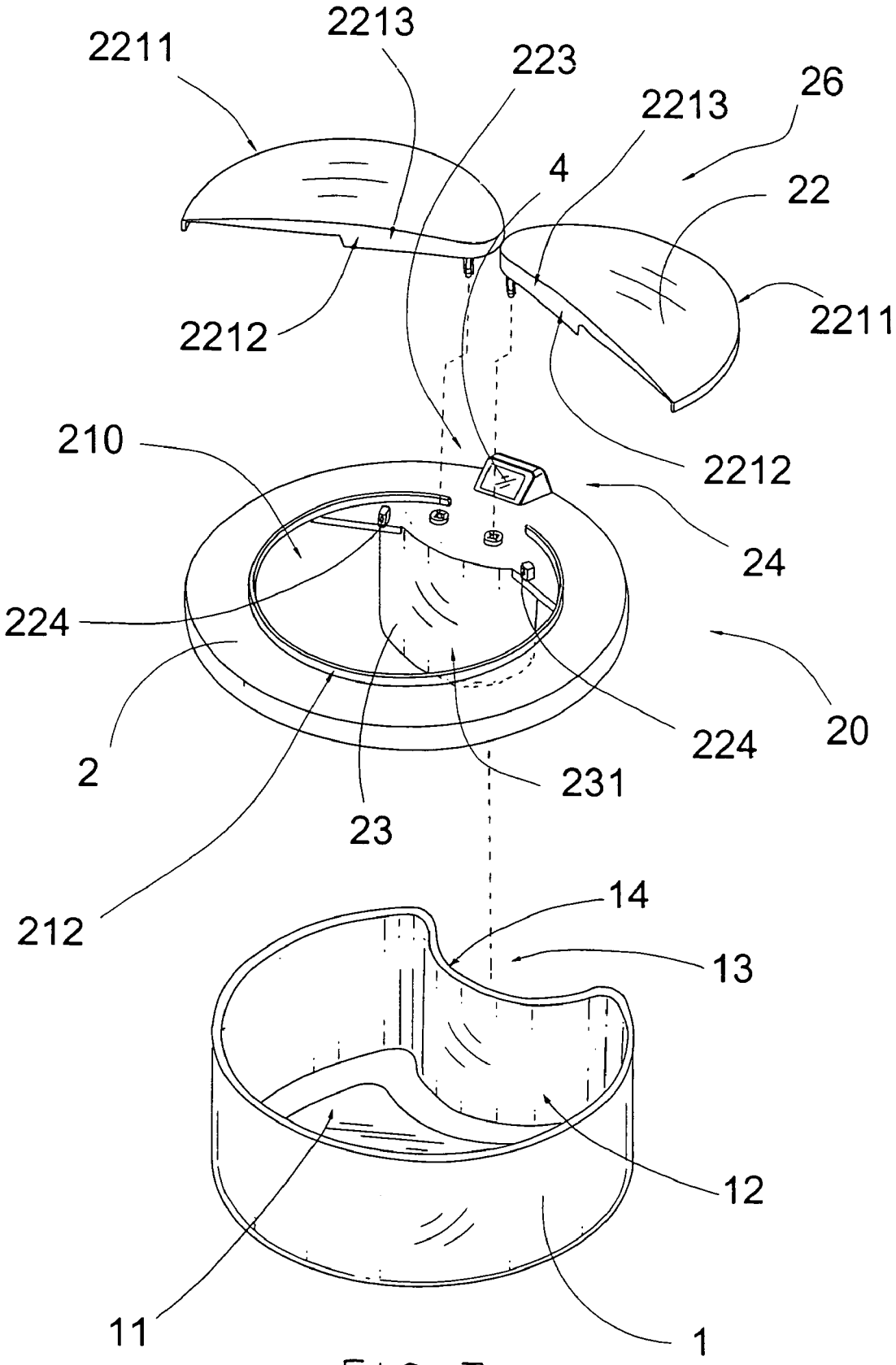
FIG. 7 is a second exploded perspective view of the container according to the above preferred embodiment of the present invention.
Figure 8:
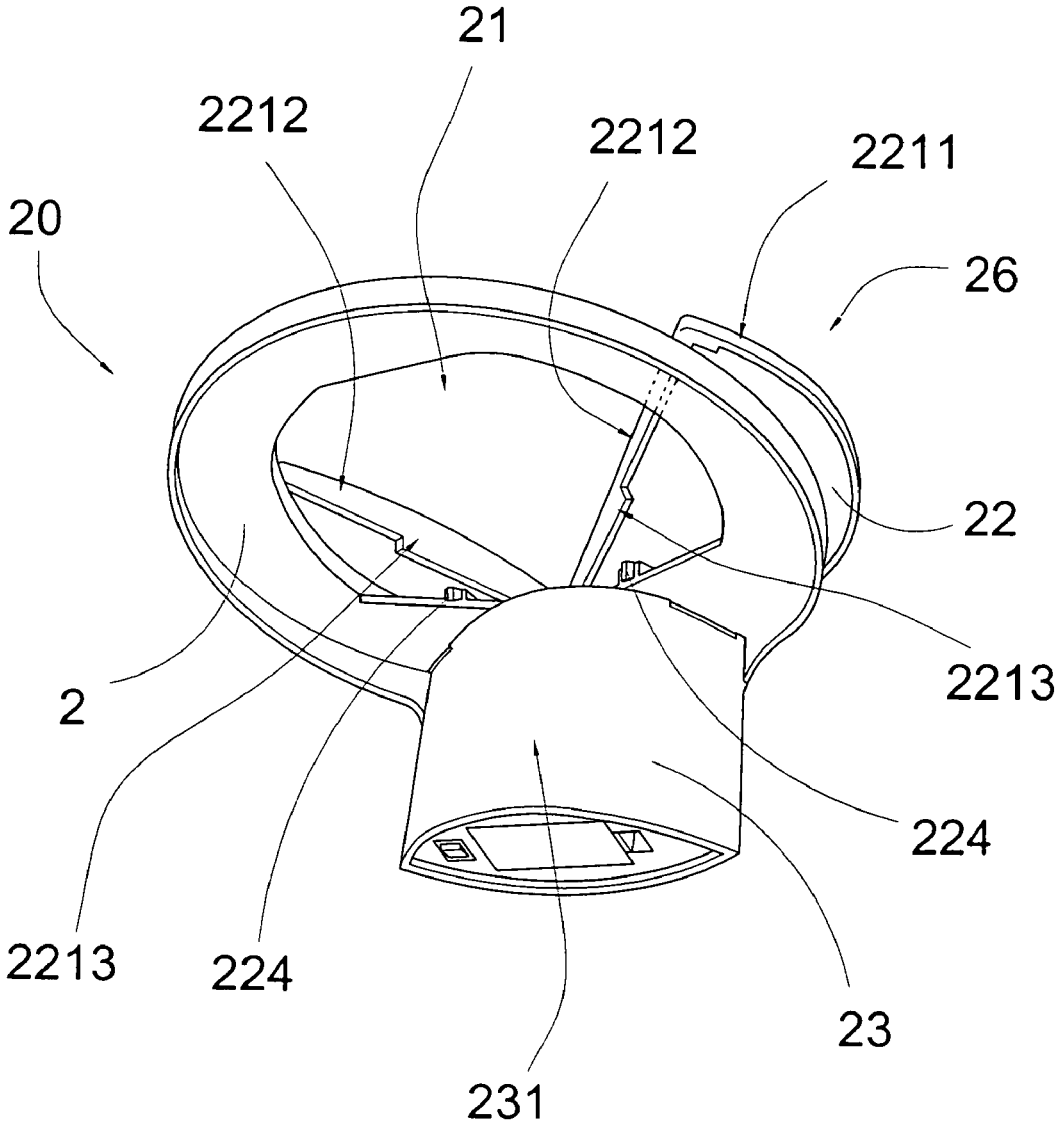
FIG. 8 is a third schematic view of the container according to the above preferred embodiment of the present invention.
Figure 9:
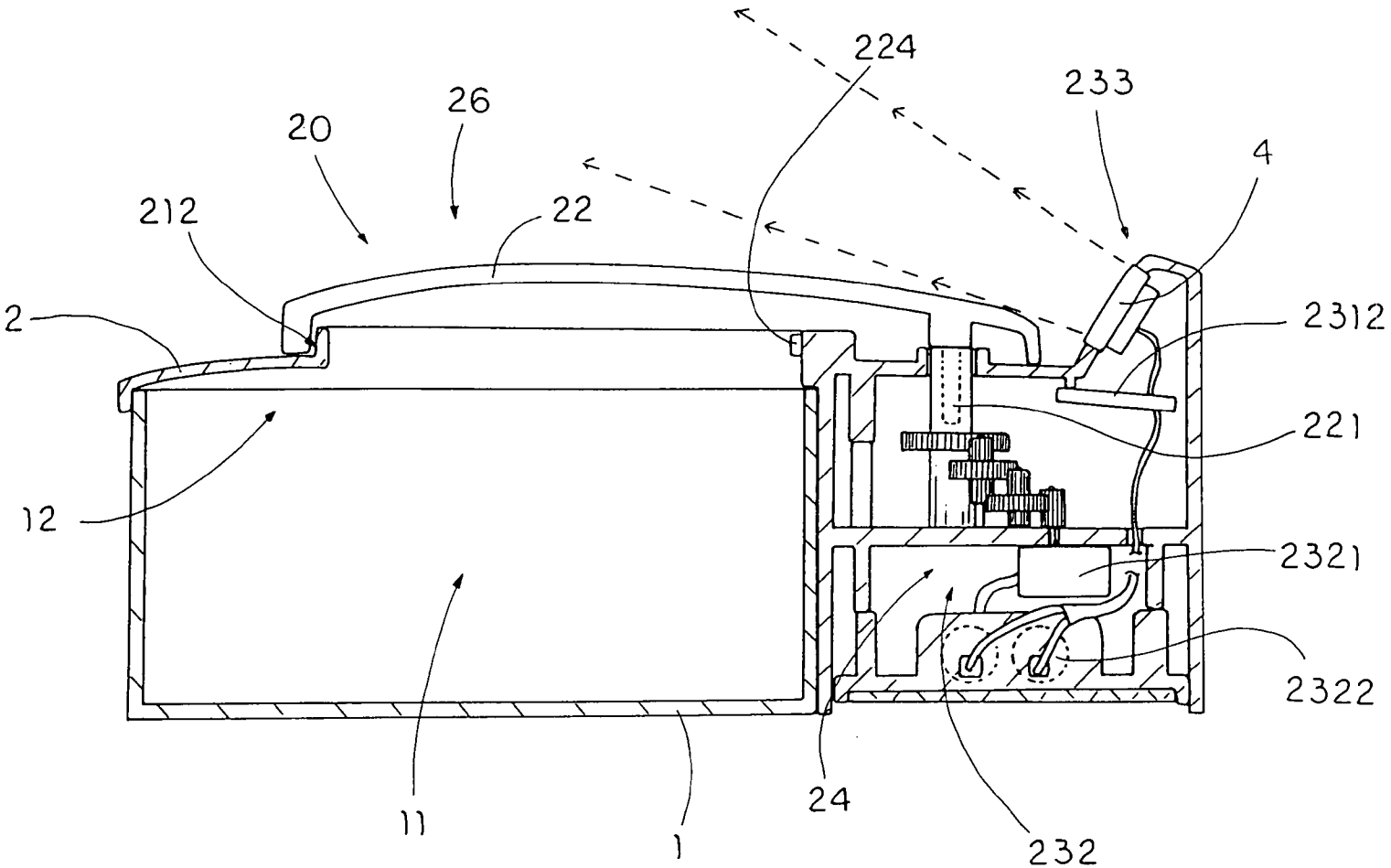
FIG. 9 is a second sectional side view of the container according to the above preferred embodiment of the present invention.

Referring to FIG. 1 to FIG. 5, FIG. 6A, FIG. 6B, and FIG. 7 to FIG. 9 of the drawings, a container according to a preferred embodiment of the present invention is illustrated, in which the container comprises a container body 1, and a container cover 20. The container is for storing trash or light personal accessories and is suitable for use in a wide variety of circumstances, such as a typical domestic environment.

The container body 1 has a container cavity 11 and a top opening 12 communicating with the container cavity 11.

The container cover 20 comprises a cover seat 2, a door panel 26 and an induction actuation arrangement 24. The cover seat 2 is sat at the top opening 12 of the container body 1, wherein the cover seat 2 has a surrounding rim 211 and an accessing window 21 defined by the surrounding rim 211 for communicating with the container cavity 11.

The door panel 26 is pivotally coupling with the cover seat 2 to move between a closed position and an opened position, wherein at the closed position, the door panel 26 is retained to cover the accessing window 21 to enclose the container cavity 11 of the container body 1, and at the opened position, the door panel 26 is pivotally and sidewardly swung to expose the accessing window 21 for communicating with the container cavity 11 so as to minimize an accessible-height restriction of the container cover 20 for the door panel 26 to be actuated.

The induction actuation arrangement 24 comprises an induction unit 233 supported by the surrounding rim 211 of the cover seat 2 for detecting a presence of an object approaching the cover seat 2 within a detection area of the induction unit 231, and an actuation unit 232 driving the door panel 26 between the closed position and the opened position.

According to the preferred embodiment of the present invention, the container body 1 has a predetermined cross section and depth for storing the trash or the personal accessories within the container cavity 11. The container body 1 has a curved cross section forming an indention at a rear portion thereof, wherein the indention is sized and shaped to fittedly engage with the container cover 20. In other words, the container body 1 further has a rear compartment 13 indently formed at a rear wall 14 of the container body 1 at the top opening 12 thereof to separate the rear compartment 13 from the container cavity 11 via the rear wall 14, wherein the container cover 20 is supported in the rear compartment 13 of the container body 1 when the container cover 20 is sat at the container body 1.

On the other hand, the door panel 26 of the container cover 20 comprises two swinging doors 22 pivotally coupling with the cover seat 2 at the accessing window 21, wherein at the closed position, the swinging doors 22 are pivotally and concurrently slid towards each other to enclose the accessing window 21 and at the opened position, the swinging doors 22 are pivotally and concurrently slid away from each other to expose the accessing window 21 so that a user may dispose thrash or personal accessories to the container cavity 11 via the accessing window 21. Alternatively, the user is also able to retrieve the personal accessories from the accessing window 21 when the swinging doors 22 are pivotally and outwardly slid to expose the accessing window 21 to an exterior of the container. Each of the swinging doors 22 preferably has a semi-circular shape and an outer curved edge 2211 and an inner longitudinal edge 2212 that when the swinging doors 22 are pivotally slid to enclose the accessing window 21, the inner longitudinal edges 2212 of the swinging doors 22 are biased against each other in a side-by-side manner so as to completely enclose the accessing window 21 for blocking entry to the container cavity 11 from an exterior of the container.

Moreover, the cover seat 2 further comprises a retention rim 212 protruded around the accessing window 21 to restrict the swinging doors 22 sliding between the closed position and the opened position, wherein at the closed position, the outer curved edges 2211 of the swinging doors 22 are blocked by the retention rim 212 to ensure the accessing window 21 being enclosed by the swinging doors 22, and at the opened position, the inner longitudinal edges 2212 of the swinging doors 22 are blocked by the retention rim 212 for preventing a further outward sliding movement of each of the swinging doors 22.

Each of the swinging doors 22 has a blocking shoulder 2213 provided at the inner longitudinal edge 2212 thereof to define a guiding edge portion positioned above the retention rim 212 and a blocking edge portion positioned below the retention rim 212, wherein each of the swinging doors 22 is pivotally swung until the blocking shoulder 2213 of the swinging door is blocked by the retention rim 212. Moreover, In order to prevent excessive noise being produced by the present invention when the swinging doors 22 move from the closed position to the opened position, the cover seat 2 further comprises a plurality of vibration absorption elements 224 provided on the cover seat 2 to align with the blocking shoulder 2213 in such a manner that when the swinging doors 22 is moved from the opened position to the closed position, the blocking shoulders 2213 is arranged to bias against the vibration absorption elements 224 respectively so as to minimize the noise produced by the impact between the blocking shoulder 2213 and the retention rim 212 when the swinging doors 22 are at the closed position.

Figure 14:
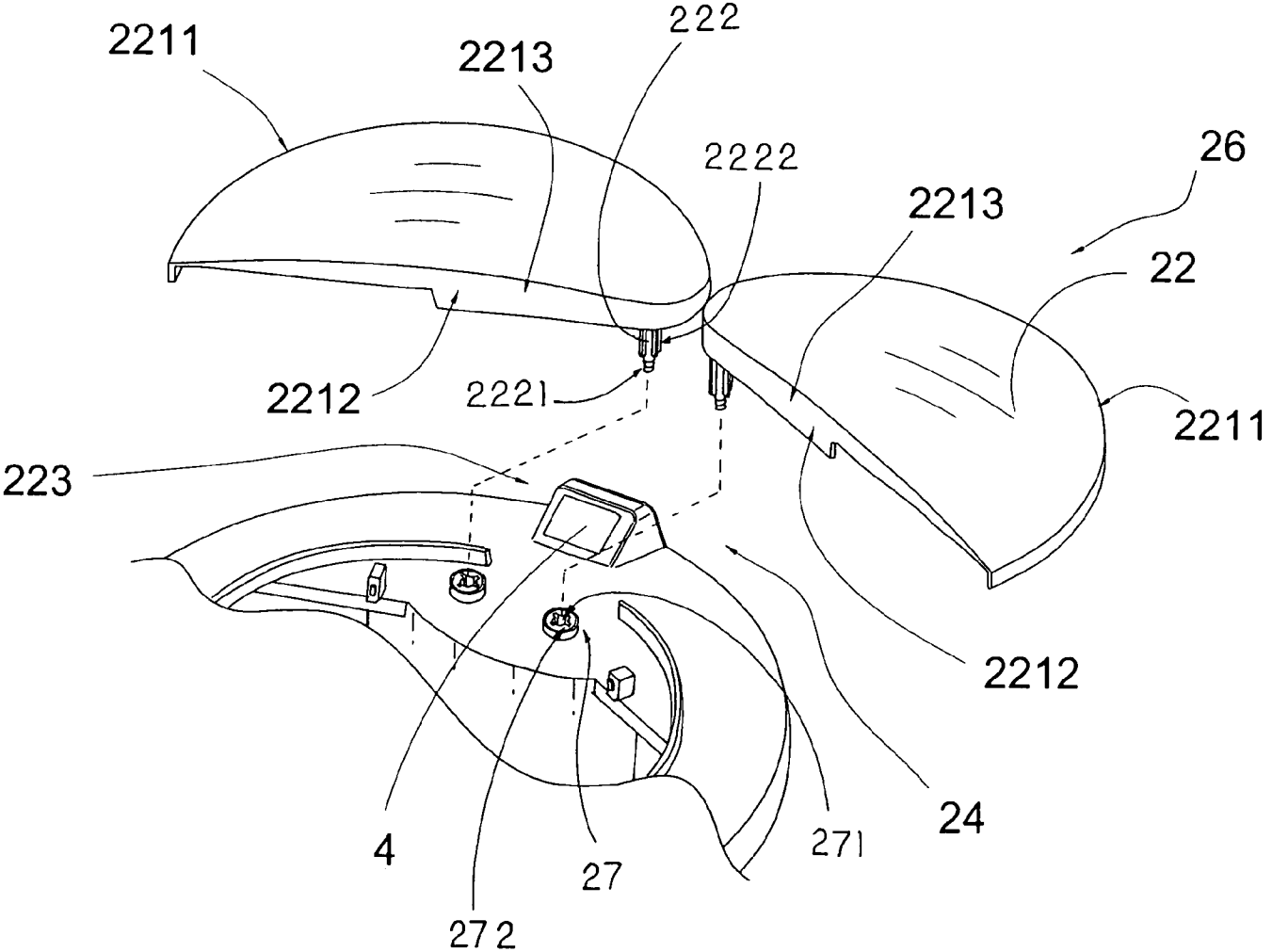
FIG. 14 is a perspective view of the container cover according to the above preferred embodiment of the present invention.
Figure 15:
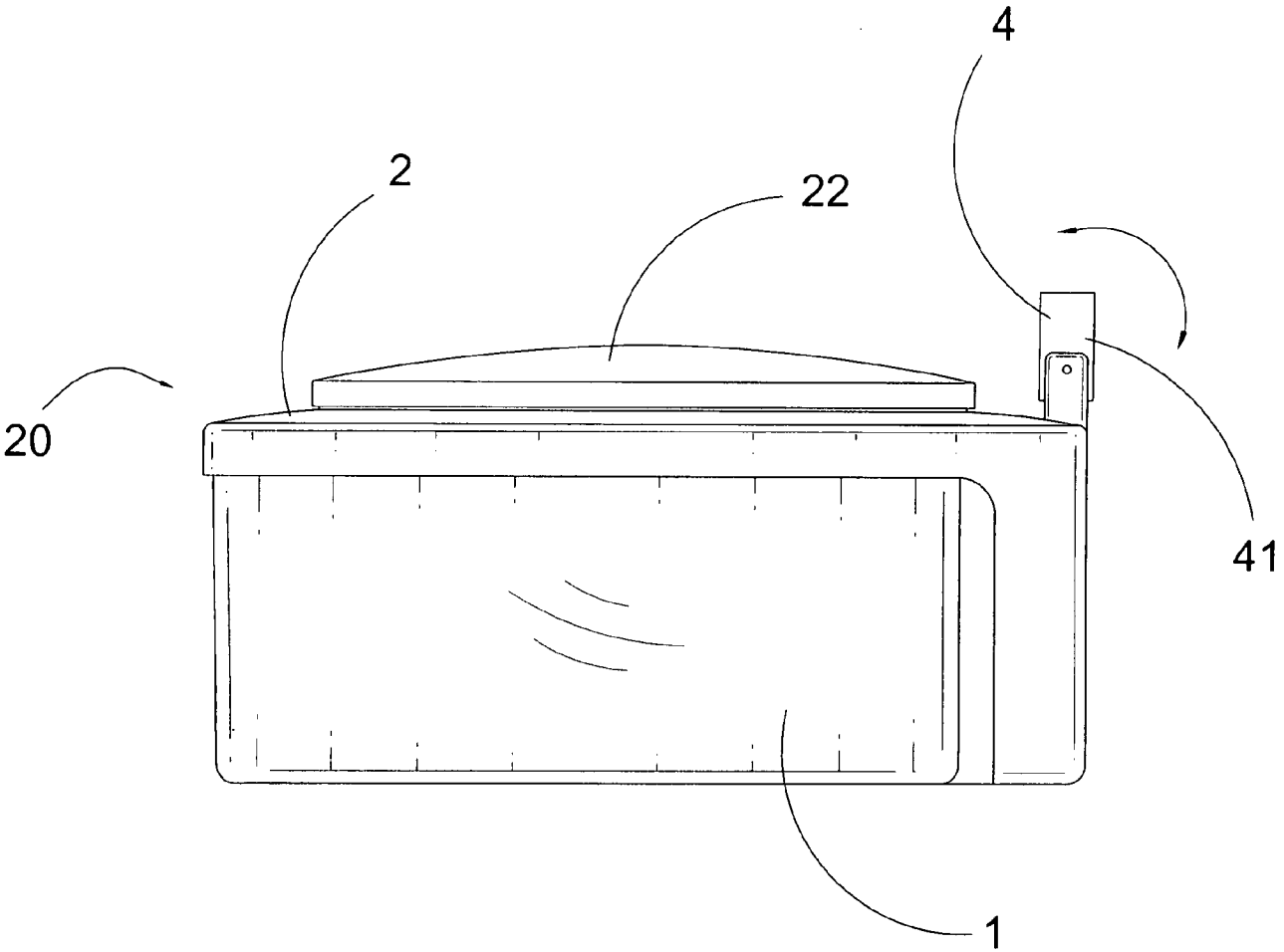
FIG. 15 is a fourth schematic diagram of an alternative mode of the container cover according to the above preferred embodiment of the present invention.
Figure 16:
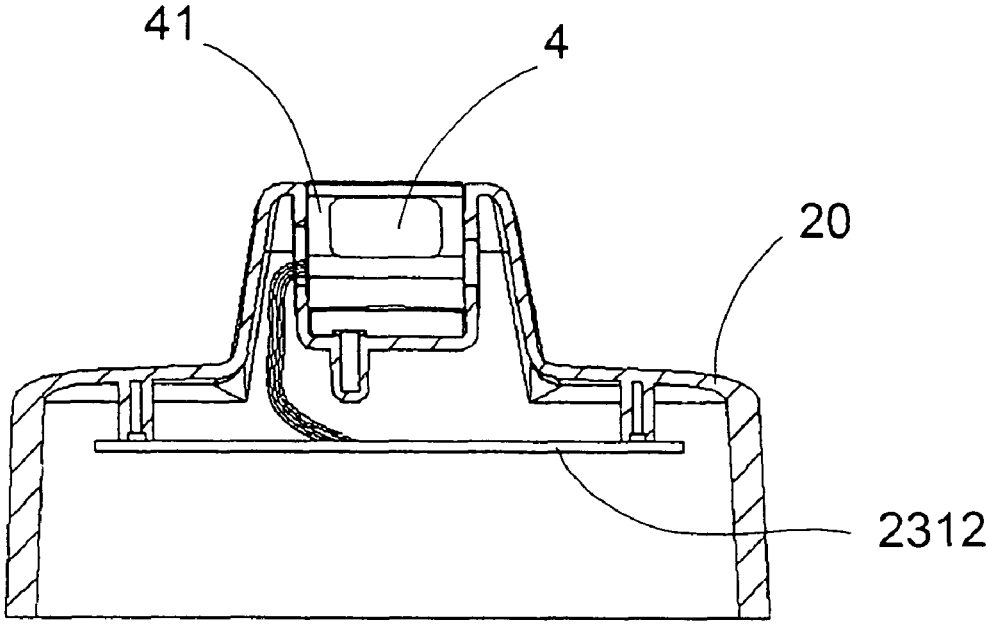
FIG. 16 is a fifth schematic diagram of an alternative mode of the container cover according to the above preferred embodiment of the present invention.
Figure 17:
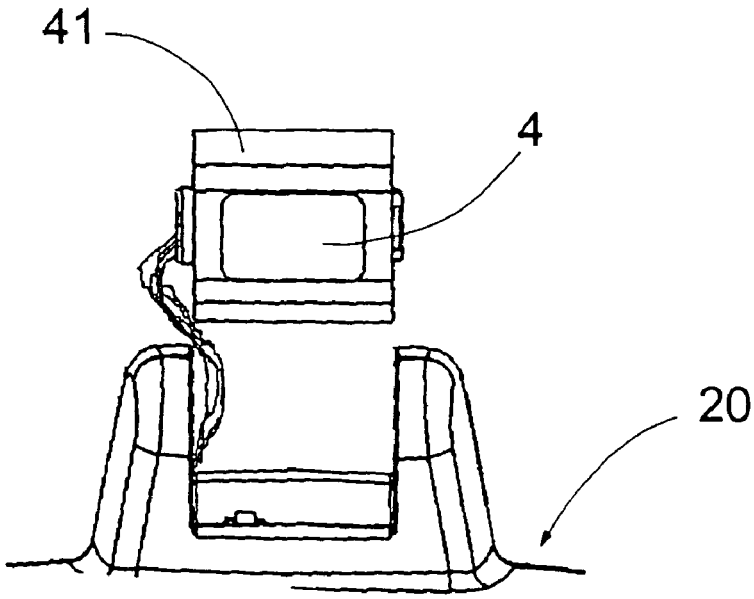
FIG. 17 is a sixth schematic diagram of an alternative mode of the container cover according to the above preferred embodiment of the present invention.
Figure 18:
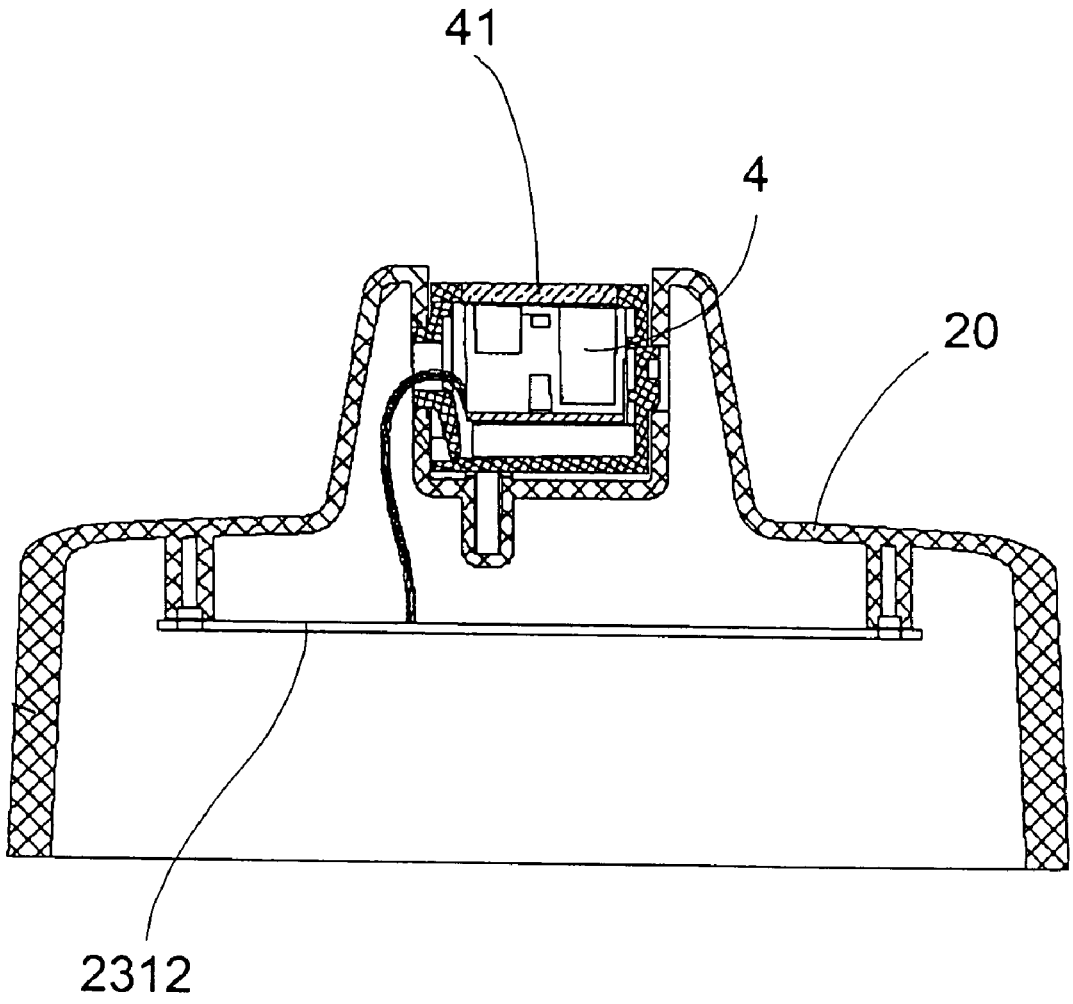
FIG. 18 is a seventh schematic diagram of an alternative mode of the container cover according to the above preferred embodiment of the present invention.
Figure 19B:
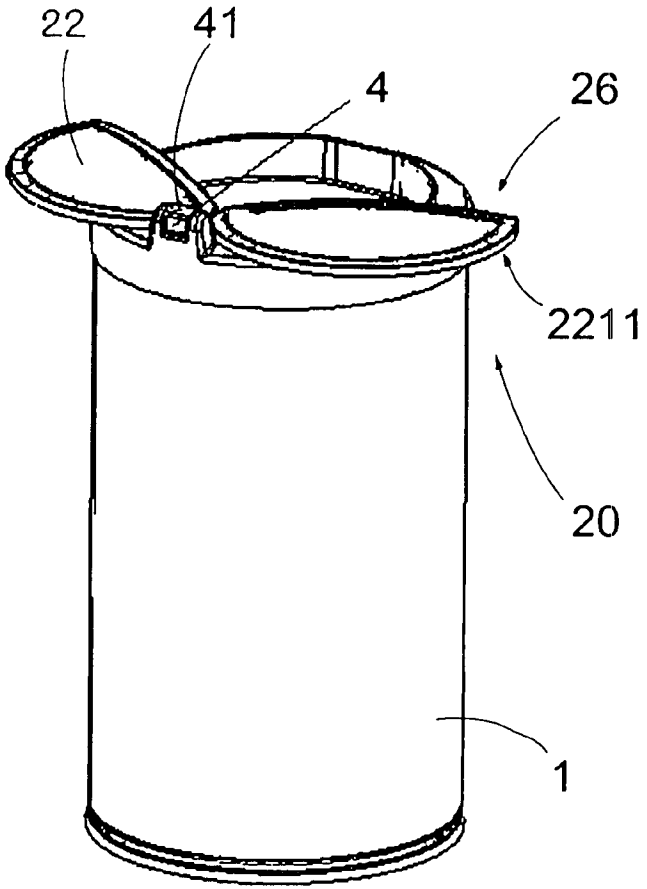
FIG. 19A and FIG. 19B are eighth and ninth schematic diagrams of an alternative mode of the container cover according to the above preferred embodiment of the present invention.
Figure 19A:
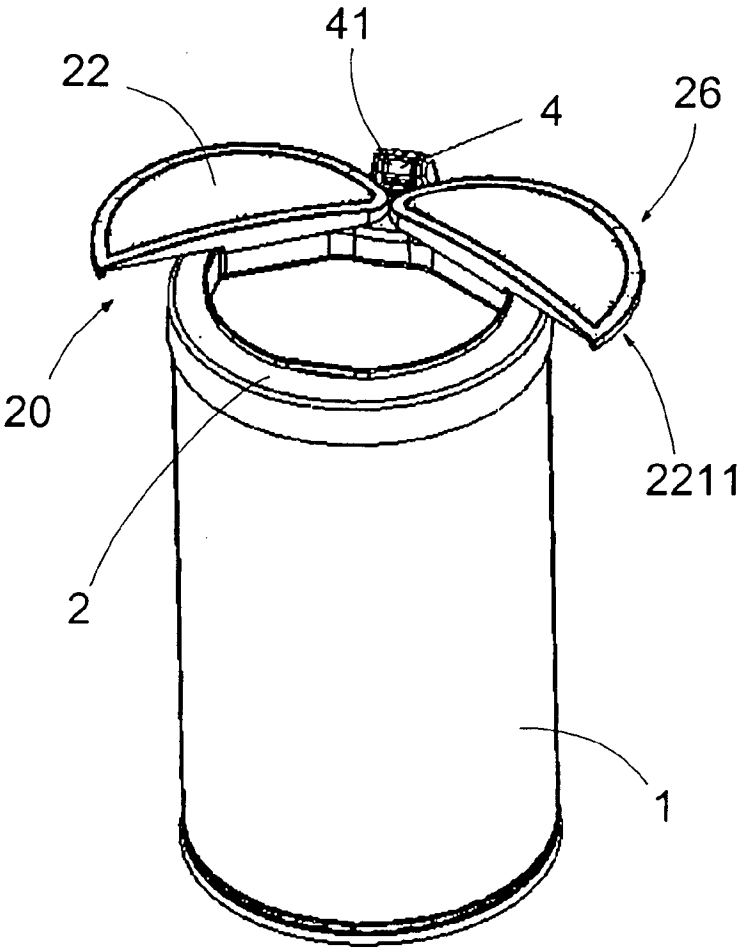

As shown in FIG. 14 of the drawings, the cover seat 2 further has a plurality of pivot slots 27 formed on thereon, wherein each of the pivot slots 27 has a mid-circular portion 271 and at least one radially extending portion 272 radially extended therefrom. Accordingly, each of the swinging doors 22 further comprises a pivot pin 222 having a central portion 2221 and a transversely extending portion 2222 radially extended from the central portion 2221, wherein each of the pivot pins 222 is arranged to fittedly inserted into the corresponding pivot slots 27 so that when the pivot pins 222 are driven to rotate, the pivot pins 222 are arranged to effectively drive the swinging doors 22 to swing sidewardly.

The cover seat 20 further comprises a rear actuation housing 23 receiving the induction actuation arrangement 24 in a hidden manner to protect the operation of the induction actuation arrangement 24. More specifically, the induction unit 233 of the induction actuation arrangement 24 comprises an induction sensor 4 upwardly protruded from the cover seat 20, and a control circuitry 2312 which is concealed in the rear actuation housing 23 to electrically couple with the induction sensor 4 and is arranged to control the door panel 26 via the actuation unit 232, wherein the door panel 26 is swung to the opened position when the induction sensor 4 detects a presence of the object within the detection area, and the door panel 26 is swung back to the closed position after the object is left from the detection area. It is worth mentioning that the rear actuation housing 23 has an engagement surface 231 fittedly engaged with the rear wall 14 of the container body 1.

As a result, the actuation unit 232 comprises a motor device 2321 having an output terminal driving the door panel 26 between the closed position and the opened position via a driving shaft 221, and a power supply 2322 electrically coupling with the induction unit 233 to actuate the motor device 2321 for driving the swinging doors 22 to move between the closed position and the opened position. Preferably, the actuation unit 232 further comprises a gear unit 31 operatively connected between the motor device 2321 and the driving shaft 221 so as to optimally control the rotational speed of the driving shaft 221 so as to control the speed of the swinging movement of the door panel 26 when it is moved from the closed position to the opened position or vice versa.

Referring to FIG. 15 to FIG. 18, FIG. 19A and FIG. 19B of the drawings, it is worth mentioning that as the alternative mode of the present invention, the induction sensor 4 can be pivotally moved so as to be adjustable for allowing the induction sensor 4 to sense the presence of the user at a distance or from an elevated height with respective to the container body 1. Thus, the induction sensor 4 can be mounted in a sensor housing 41 which is pivotally connected to the container cover 20 for allowing the induction sensor 4 to be pivotally adjustable so as to sense objects of varying heights.

Figure 10:
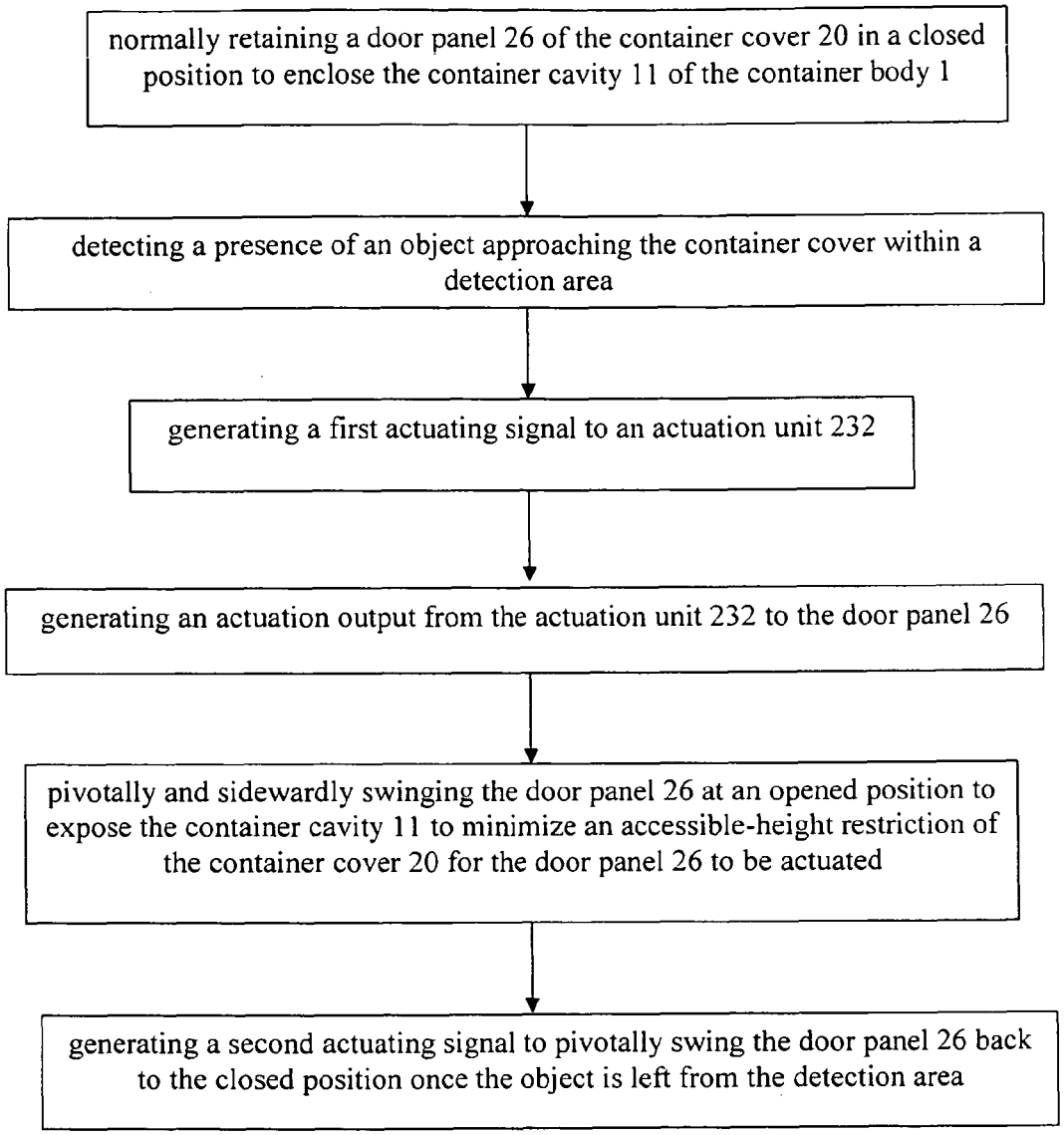
FIG. 10 is a method of controlling an operation of the container cover according to the above preferred embodiment of the present invention.

Referring to FIG. 10 of the drawings, a method of controlling an operation of an induction actuated container cover 20 for a container body 1 having a container cavity 11, wherein the method comprises the steps of:

(a) normally retaining a door panel 26 of the container cover 20 in a closed position to enclose the container cavity 11 of the container body 1;

(b) detecting a presence of an object approaching the container cover within a detection area;

(c) generating a first actuating signal to an actuation unit 232;

(d) generating an actuation output from the actuation unit 232 to the door panel 26;

(e) pivotally and sidewardly swinging the door panel 26 at an opened position to expose the container cavity 11 to minimize an accessible-height restriction of the container cover 20 for the door panel 26 to be actuated; and (f) generating a second actuating signal to pivotally swing the door panel 26 back to the closed position once the object is left from the detection area.

According to the preferred embodiment of the present invention, step (e) further comprises a step of pivotally and concurrently sliding two swinging doors 22 of the door panel 26 away from each other to expose the container cavity 11, wherein each of the swinging doors 22, having a semi-circular shape, has an outer curved edge 2211 and an inner longitudinal edge 2212 that when the swinging doors 22 are pivotally slid to enclose the container cavity 11, the inner longitudinal edges 2212 of the swinging doors 22 are biased against each other in a side-by-side manner.

Moreover, as described above, the swinging doors 22 of the door panel 26 are guided to swing between the opened position and the closed position via a retention rim 212, wherein at the closed position, the outer curved edges 2211 of the swinging doors 22 are blocked by the retention rim 212 to ensure the container cavity 11 being enclosed by the swinging doors 22, and at the opened position, the inner longitudinal edges 2212 of the swinging doors 22 are blocked by the retention rim 212 for preventing a further outward sliding movement of each of the swinging doors 22.

Figure 11:
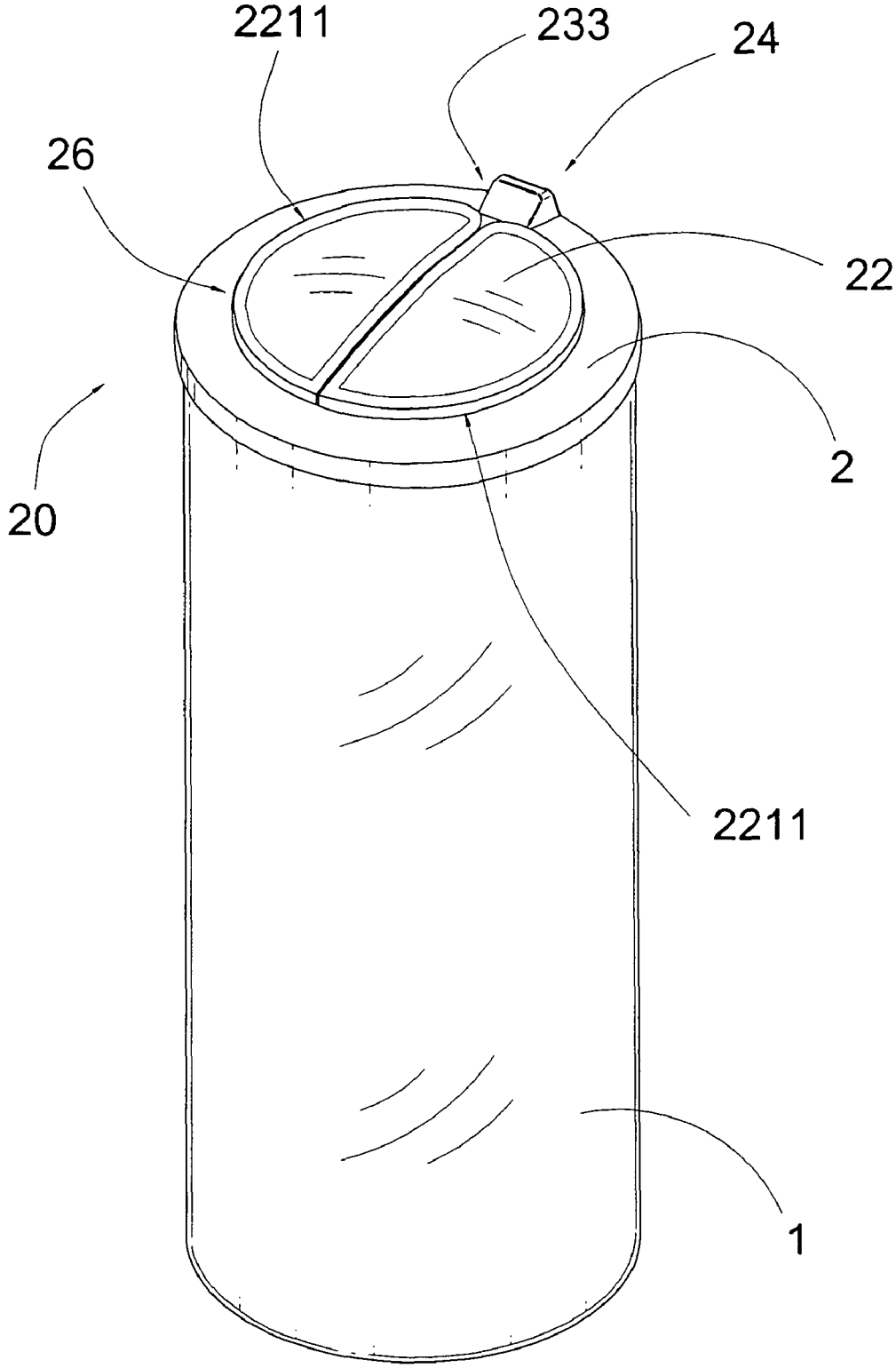
FIG. 11 is a first schematic diagram of an alternative mode of the container cover according to the above preferred embodiment of the present invention.
Figure 12:
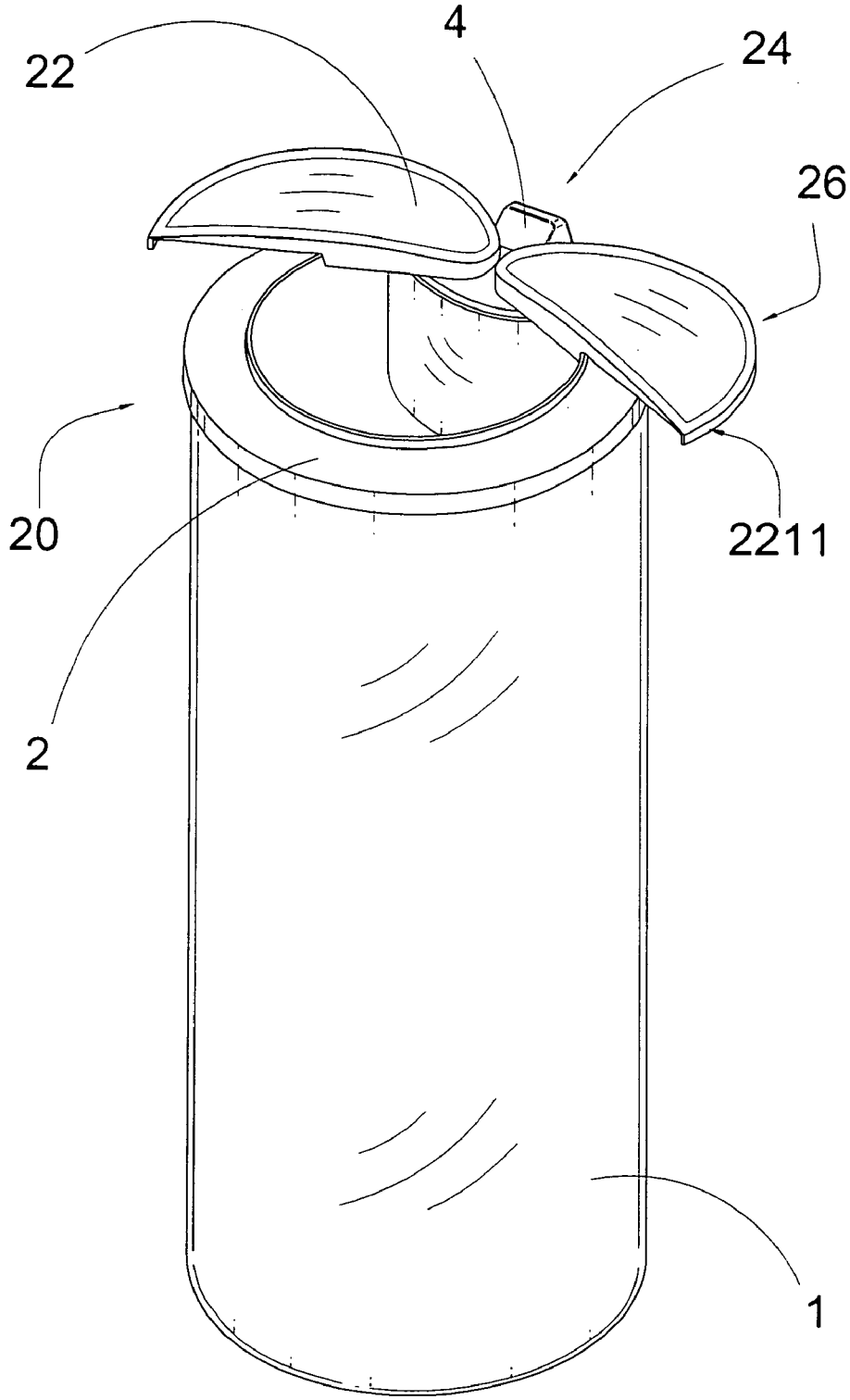
FIG. 12 is a second schematic diagram of an alternative mode of the container cover according to the above preferred embodiment of the present invention.
Figure 13:
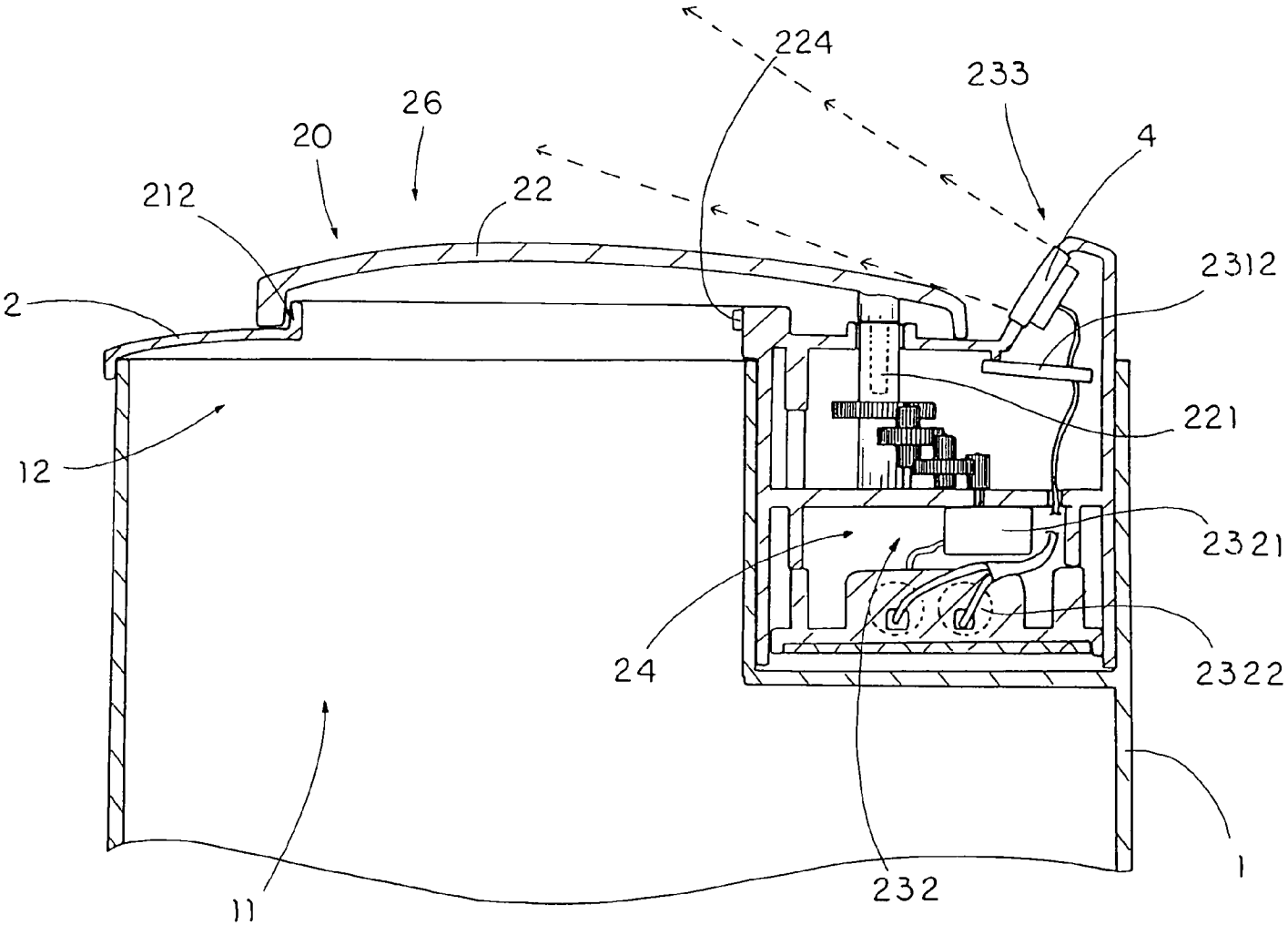
FIG. 13 is a third schematic diagram of an alternative mode of the container cover according to the above preferred embodiment of the present invention.

As an alternative of the present invention, as shown in FIG. 11 to FIG. 13 of the drawings, the container body 1 of the present invention can be embodied as having a substantial height so as to form a trash can.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container, comprising:

a container body having a container cavity and a top opening communicating with said container cavity; and a container cover which comprises:

a cover seat being sat at said top opening of said container body, wherein said cover seat has a surrounding rim and an accessing window defined by said surrounding rim for communicating with said container cavity;

a door panel pivotally coupling with said cover seat to move between a closed position and an opened position, wherein at said closed position, said door panel is retained to cover said accessing window to enclose said container cavity of said container body, and at said opened position, said door panel is pivotally and sidewardly swung to expose said accessing window for communicating with said container cavity so as to minimize an accessible-height restriction of said container cover for said door panel to be actuated; and an induction actuation arrangement which comprises an induction unit supported by said surrounding rim of said cover seat for detecting a presence of an object approaching said cover seat within a detection area of said induction unit, and an actuation unit driving said door panel between said closed position and said opened position.

2. The container, as recited in claim 1, wherein said door panel comprises two swinging doors pivotally coupling with said cover seat at said accessing window, wherein at said closed position, said swinging doors are pivotally and concurrently slid towards each other to enclose said accessing window and at said opened position, said swinging doors are pivotally and concurrently slid away each other to expose said accessing window.

3. The container, as recited in claim 2, wherein each of said swinging door, having a semi-circular shape, has an outer curved edge and an inner longitudinal edge that when said swinging doors are pivotally slid to enclose said accessing window, said inner longitudinal edges of said swinging doors are biased each other side by side.

4. The container, as recited in claim 3, wherein said cover seat further comprises a retention rim protruded around said accessing window to restrict said swinging doors sliding between said closed position and said opened position, wherein at said closed position, said outer curved edges of said swinging doors are blocked by said retention rim to ensure said accessing window being enclosed by said swinging doors, and at said opened position, said inner longitudinal edges of said swinging doors are blocked by said retention rim for preventing a further outward sliding movement of each of said swinging doors.

5. The container, as recited in claim 4, wherein each of said swinging doors has a blocking shoulder provided at said inner longitudinal edge thereof to define a guiding edge portion positioned above said retention rim and a blocking edge portion positioned below said retention rim, wherein each of said swinging doors is pivotally swung until said blocking shoulder of said swinging door is blocked by said retention rim.

6. The container, as recited in claim 5, wherein said cover seat further comprises a rear actuation housing receiving said induction actuation arrangement in a hidden manner to protect the operation of said induction actuation arrangement.

7. The container, as recited in claim 6, wherein said container body further has a rear compartment indently formed at a rear wall of said container body at said top opening thereof to separate said rear compartment from said container cavity via said rear wall, wherein said rear actuation housing of said container cover is received in said rear compartment of said container body when said container cover is sat at said container body.

8. The container, as recited in claim 7, wherein said induction unit comprises an induction sensor upwardly protruded from said cover seat, and a control circuitry which is concealed in said rear actuation housing to electrically couple with said induction sensor and is arranged to control said door panel via said actuation unit, wherein said door panel is swung to said opened position when said induction sensor detects a presence of the object within said detection area, and said door panel is swung back to said closed position after the object is left from said detection area.

9. The container, as recited in claim 8, wherein said actuation unit comprises a motor device having an output terminal driving said door panel between said closed position and said opened position, and a power supply electrically coupling with said induction unit to actuate said motor device.

10. The container, as recited in claim 6, wherein said induction unit comprises an induction sensor upwardly protruded from said cover seat, and a control circuitry which is concealed in said rear actuation housing to electrically couple with said induction sensor and is arranged to control said door panel via said actuation unit, wherein said door panel is swung to said opened position when said induction sensor detects a presence of the object within said detection area, and said door panel is swung back to said closed position after the object is left from said detection area.

11. The container, as recited in claim 6, wherein said actuation unit comprises a motor device having an output terminal driving said door panel between said closed position and said opened position, and a power supply electrically coupling with said induction unit to actuate said motor device.

12. The container, as recited in claim 5, wherein said actuation unit comprises a motor device having an output terminal driving said door panel between said closed position and said opened position, and a power supply electrically coupling with said induction unit to actuate said motor device.

13. The container, as recited in claim 3, wherein said cover seat further comprises a rear actuation housing receiving said induction actuation arrangement in a hidden manner to protect the operation of said induction actuation arrangement.

14. The container, as recited in claim 13, wherein said container body further has a rear compartment indently formed at a rear wall of said container body at said top opening thereof to separate said rear compartment from said container cavity via said rear wall, wherein said rear actuation housing of said container cover is received in said rear compartment of said container body when said container cover is sat at said container body.

15. The container, as recited in claim 1, wherein said cover seat further comprises a rear actuation housing receiving said induction actuation arrangement in a hidden manner to protect the operation of said induction actuation arrangement.

16. The container, as recited in claim 15, wherein said container body further has a rear compartment indently formed at a rear wall of said container body at said top opening thereof to separate said rear compartment from said container cavity via said rear wall, wherein said rear actuation housing of said container cover is received in said rear compartment of said container body when said container cover is sat at said container body.

17. The container, as recited in claim 15, wherein said induction unit comprises an induction sensor upwardly protruded from said cover seat, and a control circuitry which is concealed in said rear actuation housing to electrically couple with said induction sensor and is arranged to control said door panel via said actuation unit, wherein said door panel is swung to said opened position when said induction sensor detects a presence of the object within said detection area, and said door panel is swung back to said closed position after the object is left from said detection area.

18. A method of controlling an operation of an induction actuated container cover for a container body having a container cavity, wherein said method comprises the steps of:

(a) normally retaining a door panel of said container cover in a closed position to enclose said container cavity of said container body;

(b) detecting a presence of an object approaching said container cover within a detection area;

(c) generating a first actuating signal to an actuation unit;

(d) generating an actuation output from said actuation unit to said door panel;

(e) pivotally and sidewardly swinging said door panel at an opened position to expose said container cavity to minimize an accessible-height restriction of said container cover for said door panel to be actuated; and (f) generating a second actuating signal to pivotally swing said door panel back to said closed position once the object is left from said detection area.

19. The method as recited in claim 18 wherein the step (e) further comprises a step of pivotally and concurrently sliding two swinging doors of said door panel away from each other to expose said container cavity, wherein each of said swinging door, having a semi-circular shape, has an outer curved edge and an inner longitudinal edge that when said swinging doors are pivotally slid to enclose said container cavity, said inner longitudinal edges of said swinging doors are biased each other side by side.

20. The method, as recited in claim 19, wherein said swinging doors of said door panel are guided to swing between said opened position and said closed position via a retention rim, wherein at said closed position, said outer curved edges of said swinging doors are blocked by said retention rim to ensure said container cavity being enclosed by said swinging doors, and at said opened position, said inner longitudinal edges of said swinging doors are blocked by said retention rim for preventing a further outward sliding movement of each of said swinging doors.

* * * * *